US006055387A

United States Patent [19]

Koshio

[11] Patent Number: 6,055,387

[45] Date of Patent: Apr. 25, 2000

[54] DEVICE AND METHOD FOR ELECTROPHOTOGRAPHIC IMAGE GENERATION

[75] Inventor: Takeshi Koshio, Niigata, Japan

[73] Assignee: NEC Corporation, Tokyo, Japan

[21] Appl. No.: 09/323,091

[22] Filed: Jun. 1, 1999

[30] Foreign Application Priority Data

Jun. 1, 1998 [JP] Japan ..... 10-165858

[51] Int. Cl.[7] ..... G03G 15/16

[52] U.S. Cl. ..... 399/55; 399/57; 399/62; 399/240

[58] Field of Search ..... 399/27, 29, 30, 399/53, 55, 57, 58, 61, 62, 237, 240, 241

[56] References Cited

U.S. PATENT DOCUMENTS

| | | | |
|---|---|---|---|
| 5,003,352 | 3/1991 | Duchesne et al. | 399/62 X |
| 5,689,779 | 11/1997 | Miyamoto et al. | 399/237 |
| 5,710,958 | 1/1998 | Raj | 399/53 X |
| 5,805,956 | 9/1998 | Kawai et al. | 399/55 X |
| 5,867,750 | 2/1999 | Do | 399/55 |
| 5,933,685 | 8/1999 | Yoo | 399/57 |

FOREIGN PATENT DOCUMENTS

| | | |
|---|---|---|
| 55-35339 | 3/1980 | Japan . |
| 55-59475 | 5/1980 | Japan . |
| 62-124567 | 6/1987 | Japan . |
| 4-278966 | 10/1992 | Japan . |
| 5-133890 | 5/1993 | Japan . |
| 5-133892 | 5/1993 | Japan . |
| 5-158342 | 6/1993 | Japan . |
| 6-130822 | 5/1994 | Japan . |
| 9-211993 | 8/1997 | Japan . |
| 9-211994 | 8/1997 | Japan . |

*Primary Examiner*—Sandra Brase
*Attorney, Agent, or Firm*—Foley & Lardner

[57] ABSTRACT

An electrophotographic image generation device such as an electrophotographic printer comprises an image bearing belt, a development section, a toner image transfer section, a toner concentration sensor, and an electrical charge control section. A latent image due to variations in electric potential is formed on the image bearing belt by irradiation of photo image light. The development section applies a liquid developing agent on the surface of the image bearing belt and thereby changes the latent image into a visible toner image. The toner image transfer section transfers the toner image on the surface of the image bearing belt to the surface of a sheet and thereby executes printing to the sheet. The toner concentration sensor detects the concentration of toner particles in the liquid developing agent. The electrical charge control section controls the amount of electrical charges on the toner particles in the liquid developing agent in the development section, according to the toner concentration detected by the toner concentration sensor. The electrical charge control is executed very quickly, for example, by controlling a development bias voltage applied to a development roller. Therefore, the density of printed picture images can be maintained constant even if the toner concentration in the liquid developing agent varied.

16 Claims, 3 Drawing Sheets

DEVICE AND METHOD FOR ELECTROPHOTOGRAPHIC IMAGE GENERATION

BACKGROUND OF THE INVENTION

The present invention relates to a device and a method for electrophotographic image generation utilizing an electrical charge image, that is, an image, shape, etc. which is formed by electrical charges on an image bearing body such as an image bearing belt, an image bearing drum, etc., and in particular, to an electrophotographic image generation device and an electrophotographic image generation method which utilize a liquid developing agent for developing a latent image which has been formed on the image bearing body.

DESCRIPTION OF THE PRIOR ART

Electrophotographic image generation devices such as printers, photocopiers, etc. which utilize electrical charge images are widely used these days. The electrical charge image means an image, shape, etc. which is formed by electrical charges on an image bearing body such as an image bearing belt, an image bearing drum, an image bearing plate, etc. The electrical charge image is generated on the image bearing body by irradiating photo image light (light corresponding to a photo image) on the surface of the image bearing body. Subsequently, a developing agent is applied on the electrical charge image (a latent image) on the image bearing body, and thereby the latent image is developed and a visible image on the image bearing body is obtained. Thereafter, in the case of printers, photocopiers, etc., a sheet of paper is carried to the image bearing body and makes contact with the image bearing body, thereby the visible image generated on the image bearing body by the developing agent is transferred to the paper, and thereby image printing to the paper is completed.

In conventional electrophotographic image generation devices, a single-component developing agent or a dual-component developing agent has been employed as the developing agent. The single-component developing agent means a developing agent including toner particles only, and the dual-component developing agent means a developing agent including magnetic carrier particles and toner particles mixed together. When the single-component developing agent or the dual-component developing agent is utilized, the toner density or the toner concentration can be maintained constant even if the amount of the toner or the developing agent stored in a development section of the electrophotographic image generation device varied.

However, in order to realize electrophotographic image generation with more fineness or delicacy, the size of the toner particle has to be made smaller. Meanwhile, reducing the size of the toner particle makes the toner particles tend to cluster together.

For resolving such problems, use of a liquid developing agent, in which liquid solvent and toner particles are mixed together, is under examination these days. An example of the construction of a developing device for applying the liquid developing agent on the surface of the image bearing body has been disclosed in Japanese Patent Application Laid-Open No.HEI9-211993, for example.

In the case where the liquid developing agent is employed as the developing agent, the concentration of the toner particles in the liquid developing agent tends to vary as time passes, and thus the toner concentration has to be managed and controlled appropriately. In order to control the toner concentration, generally, the toner concentration is detected by a detector, and the liquid solvent or the toner particles are adequately added to the liquid developing agent according to the measurement of the toner concentration, as disclosed in Japanese Patent Application laid-Open No.HEI4-278966 etc. A toner concentration sensor which can prevent the toner particles from clustering together and thereby avoid the stopping up of the gap between its light emitting element and its photoreceptor element has been disclosed in Japanese Patent Application Laid-Open No.HEI5-133890. In the toner concentration sensor disclosed in the document, parts of the light emitting element and the photoreceptor element that make contact with the liquid developing agent are formed of material having the same polarity as the toner particles in the liquid developing agent.

However, the above toner concentration control method involves a time lag in controlling the toner concentration adequately. In other words, it takes a little time until the attainment of a desired toner concentration after the addition of the liquid solvent or the toner particles, and thus the density of the generated picture image is necessitated to be changed during the time lag.

In a wet developing device which has been disclosed in Japanese Patent Application Laid-Open No.HEI6-130822, toner liquid is poured into a development gap between a development electrode and a rear electrode, and an electrophotographic plate (an image bearing plate) on which a latent image has been formed is passed through the development gap between the development electrode and the rear electrode, thereby toner particles in the toner liquid is applied on the latent image which has been formed on the surface of the electrophotographic plate, and thereby development of the latent image is executed and a visible toner image is generated on the electrophotographic plate. In the wet developing device of the document, the development electrode is designed in the shape of a caterpillar track so as to be able to change the length of its part facing the rear electrode, thereby the amount of toner particles which are applied to the electrophotographic plate is controlled according to the measurement of the toner concentration.

However, such a method also includes the time lag in controlling the picture density, and the picture density control can be executed only roughly with respect to time. Concretely, the method is not suitable for controlling the picture density appropriately during development of one electrophotographic plate.

SUMMARY OF THE INVENTION

It is therefore the primary object of the present invention to provide an electrophotographic image generation device, by which variations in the image density in electrophotographic image generation employing the liquid developing agent can be avoided even if the toner concentration in the liquid developing agent varied, and thereby uniform and finer electrophotographic image generation can be realized by the use of the liquid developing agent in which the size of the toner particles can easily be made smaller.

Another object of the present invention is to provide an electrophotographic image generation method, by which variations in the image density in electrophotographic image generation employing the liquid developing agent can be avoided even if the toner concentration in the liquid developing agent varied, and thereby uniform and finer electrophotographic image generation can be realized by the use of the liquid developing agent in which the size of the toner particles can easily be made smaller.

In accordance with a first aspect of the present invention, there is provided an electrophotographic image generation device comprising a development means, a toner concentration detection means, and an electrical charge control means. The development means applies a liquid developing agent to the surface of an image bearing body on which a latent image due to variations in electric potential has been formed by irradiation of photo image light, and thereby changes the latent image into a visible toner image. The toner concentration detection means detects the concentration of toner particles in the liquid developing agent. The electrical charge control means controls the amount of electrical charges on the toner particles in the liquid developing agent in the development means according to the toner concentration detected by the toner concentration detection means.

In accordance with a second aspect of the present invention, in the first aspect, the development means includes a development roller for applying the liquid developing agent to the surface of the image bearing body, and a development bias voltage is applied to the development roller by a power source.

In accordance with a third aspect of the present invention, in the second aspect, the electrical charge control means controls the amount of electrical charges on the toner particles on the development roller, by controlling the development bias voltage applied by the power source according to the toner concentration detected by the toner concentration detection means.

In accordance with a fourth aspect of the present invention, in the third aspect, the toner concentration detection means is placed in the proximity of the development roller.

In accordance with a fifth aspect of the present invention, in the first aspect, the electrophotographic image generation device further comprises a liquid developing agent control addition means. The liquid developing agent control addition means adequately adds the liquid solvent or the toner particles of the liquid developing agent to the liquid developing agent to be consumed by the development means, depending on variations in the toner concentration in the liquid developing agent.

In accordance with a sixth aspect of the present invention, there is provided an electrophotographic image generation device comprising an image bearing means, a development means, a toner image transfer means, a toner concentration detection means, and an electrical charge control means. On the image bearing means, a latent image due to variations in electric potential is formed by irradiation of photo image light. The development means applies a liquid developing agent to the surface of the image bearing means, and thereby changes the latent image into a visible toner image. The toner image transfer means transfers the toner image on the surface of the image bearing means to the surface of a sheet, and thereby executes printing to the sheet. The toner concentration detection means detects the concentration of toner particles in the liquid developing agent. The electrical charge control means controls the amount of electrical charges on the toner particles in the liquid developing agent in the development means, according to the toner concentration detected by the toner concentration detection means.

In accordance with a seventh aspect of the present invention, in the sixth aspect, the development means includes a development roller for applying the liquid developing agent to the surface of the image bearing means, and a development bias voltage is applied to the development roller by a power source.

In accordance with an eighth aspect of the present invention, in the seventh aspect, the electrical charge control means controls the amount of electrical charges on the toner particles on the development roller, by controlling the development bias voltage applied by the power source according to the toner concentration detected by the toner concentration detection means.

In accordance with a ninth aspect of the present invention, in the eighth aspect, the toner concentration detection means is placed in the proximity of the development roller.

In accordance with a tenth aspect of the present invention, in the sixth aspect, the electrophotographic image generation device further comprises a liquid developing agent control addition means. The liquid developing agent control addition means adequately adds the liquid solvent or the toner particles of the liquid developing agent to the liquid developing agent to be consumed by the development means, depending on variations in the toner concentration in the liquid developing agent.

In accordance with an eleventh aspect of the present invention, there is provided an electrophotographic image generation method for an electrophotographic image generation device which is provided with a development means for applying a liquid developing agent on the surface of an image bearing body on which a latent image due to variations in electric potential has been formed by irradiation of photo image light, and thereby changing the latent image into a visible toner image. According to the electrophotographic image generation method, the concentration of toner particles in the liquid developing agent is detected, and the amount of electrical charges on the toner particles in the liquid developing agent in the development means is controlled according to the detected toner concentration.

In accordance with a twelfth aspect of the present invention, in the eleventh aspect, a development bias voltage is applied by a power source to a development roller which is provided in the development means for applying the liquid developing agent to the surface of the image bearing body.

In accordance with a thirteenth aspect of the present invention, in the twelfth aspect, the control of the amount of electrical charges on the toner particles in the liquid developing agent in the development means is executed by controlling the development bias voltage applied by the power source to the development roller according to the detected toner concentration.

In accordance with a fourteenth aspect of the present invention, in the thirteenth aspect, the toner concentration is detected in the proximity of the development roller.

In accordance with a fifteenth aspect of the present invention, in the eleventh aspect, the toner image on the surface of the image bearing body is transferred to the surface of a sheet and thereby printing to the sheet is executed.

In accordance with a sixteenth aspect of the present invention, in the eleventh aspect, the liquid solvent or the toner particles of the liquid developing agent are adequately added to the liquid developing agent to be consumed by the development means, depending on variations in the toner concentration in the liquid developing agent.

BRIEF DESCRIPTION OF THE DRAWINGS

The objects and features of the present invention will become more apparent from the consideration of the following detailed description taken in conjunction with the accompanying drawings, in which.

DESCRIPTION OF THE PREFERRED EMBODIMENTS

Figure 1:
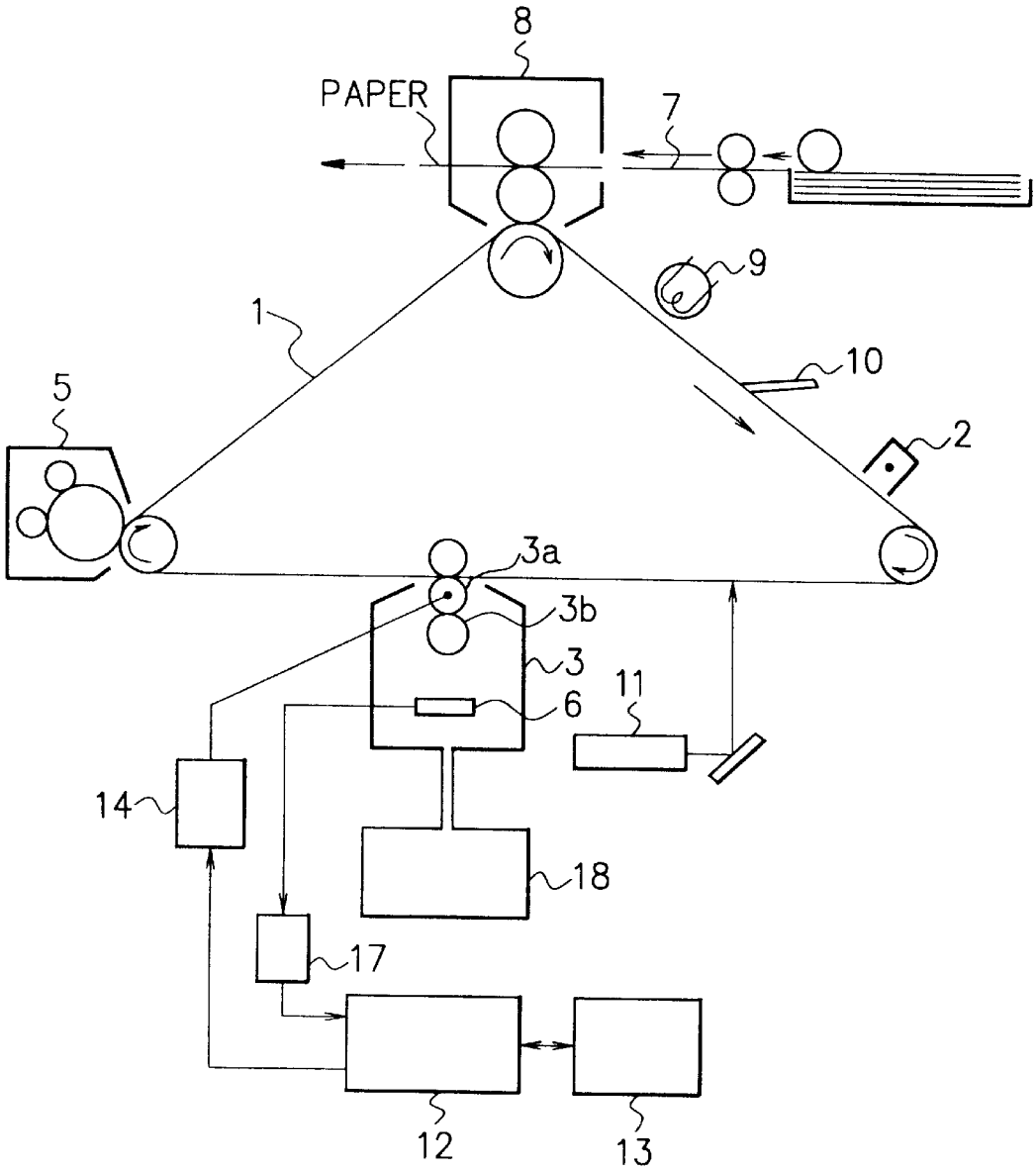
FIG. 1 is a schematic diagram showing the construction of an electrophotographic printer as an electrophotographic image generation device according to an embodiment of the present invention.

Referring now to the drawings, a description will be given in detail of preferred embodiments in accordance with the present invention.

FIG. 1 is a schematic diagram showing the construction of an electrophotographic printer as an electrophotographic image generation device according to an embodiment of the present invention. The electrophotographic printer of FIG. 1 comprises an image bearing belt (image bearing body) 1, a charging section 2, a development section 3, a drying section 5, a toner concentration sensor 6, a toner image transfer section 8, a neutralizer lamp 9, a cleaning section 10, a scanning optical unit 11, a CPU (Central Control Unit) 12, a memory unit 13, a power supply 14, an A/D converter 17, and a developing agent tank 18.

The image bearing belt 1 as the image bearing body is supported and rotated by three rollers shown in FIG. 1. The charging section 2 is placed beside the image bearing belt 1 in order to charge the image bearing belt 1 uniformly. The surface of the image bearing belt 1 is irradiated with light corresponding to a photo image (hereafter, referred to as "photo image light") by the scanning optical unit 11, and thereby a latent image due to variations in electric potential is formed on the surface of the image bearing belt 1. The development section 3 applies the liquid developing agent to the latent image formed on the surface of the image bearing belt 1, and thereby changes the latent image into a visible toner image. The drying section 5 dries the image bearing belt 1 so that the solvent of the liquid developing agent will be removed from the surface of the image bearing belt 1, and thereby a toner image is completed on the surface of the image bearing belt 1.

The toner concentration sensor 6 is provided in the development section 3, and detects the concentration of the toner in the liquid developing agent which is stored in the development section 3. The toner image transfer section 8 transfers the toner image on the surface of the image bearing belt 1 to a sheet of paper which is carried to the toner image transfer section 8 along a paper feed line 7. The neutralizer lamp 9 irradiates the image bearing belt 1 with light, and thereby neutralizes the electrical charges remaining on the surface of the image bearing belt 1 after the toner image transfer. The cleaning section 10 cleans the toner remaining on the surface of the image bearing belt 1 after the toner image transfer.

The CPU 12 controls the operations of the components of the electrophotographic printer. The memory unit 13 stores image data, setting values, etc., in which the setting values is maintained undeleted even when power is shut down.

The development section 3 utilizes the liquid developing agent. The liquid developing agent is a developing agent including liquid solvent and toner particles mixed together. The development section 3 is provided with a development roller 3*a* and a supply roller 3*b* which are rotated according to the movement of the image bearing belt 1. To the development roller 3*a*, a development bias voltage is applied by the power supply 14, and the development bias voltage is controlled by the CPU 12. For example, when the CPU 12 raised the development bias voltage, the toner potential is increased, that is, the electrical charges on the toner particles in the liquid developing agent are increased, and thereby the density of printed picture images is relatively raised.

The operations of the components of the electrophotographic printer and the above development bias voltage are controlled by the CPU 12. The CPU 12 controls the development bias voltage based on the result of the detection of the toner concentration by the toner concentration sensor 6. Preferably, the toner concentration sensor 6 is placed in the vicinity of the development roller 3*a*. An analog signal outputted by the toner concentration sensor 6 is supplied to the A/D converter 17 for converting the analog signal to a digital signal, and the digital signal outputted by the A/D converter 17 is inputted to the CPU 12.

Figure 2:
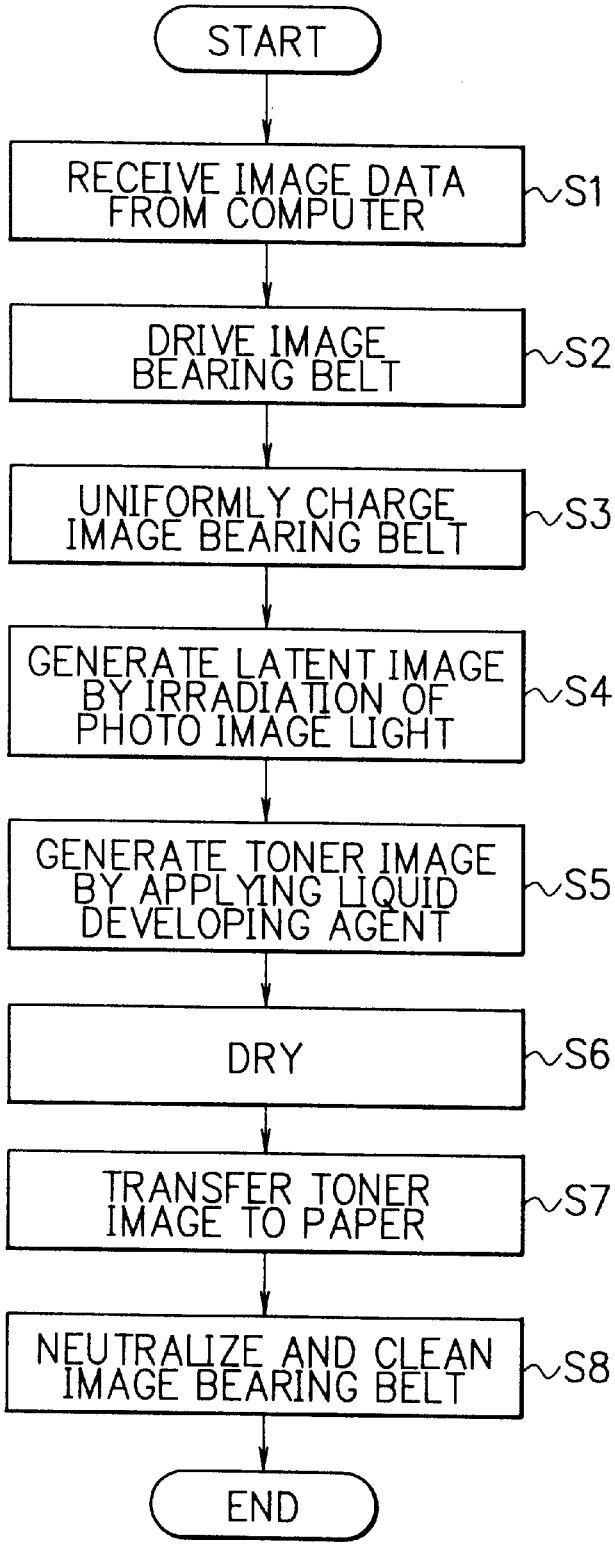
FIG. 2 is a flow chart showing the operation of the electrophotographic printer of FIG. 1.
Figure 3:
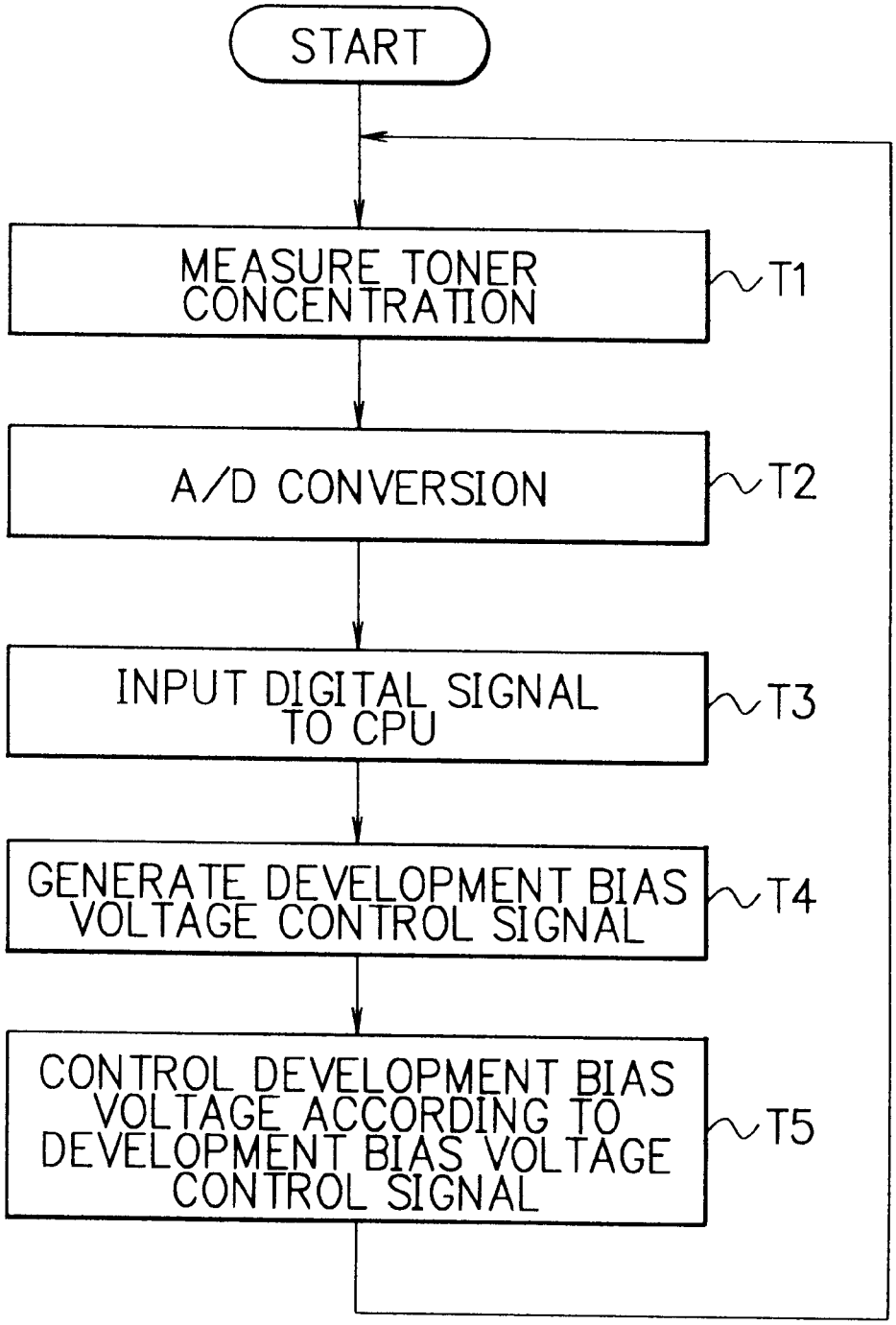
FIG. 3 is a flow chart showing an image density control operation which is executed by the electrophotographic printer of FIG. 1.

In the following, the operation of the electrophotographic printer according to the embodiment of the present invention will be described in detail, referring to FIG. 1 through FIG. 3. FIG. 2 is a flow chart showing the operation of the electrophotographic printer of FIG. 1, and FIG. 3 is a flow chart showing an image density control operation which is executed by the electrophotographic printer of FIG. 1.

Referring to FIG. 2, when image data is supplied from a host computer etc. to the electrophotographic printer (step S1), the image bearing belt 1 is driven by rollers (step S2), and the image bearing belt 1 is charged uniformly by the charging section 2 (step S3). Subsequently, the photo image light is irradiated on the surface of the image bearing belt 1 by the scanning optical unit 11, and thereby a latent image is generated on the surface of the image bearing belt 1 (step S4). Subsequently, the liquid developing agent is applied to the surface of the image bearing belt 1 by the development roller 3*a* of the development section 3, and thereby the latent image on the surface of the image bearing belt 1 is changed into a visible toner image (step S5). The liquid developing agent stored in the developing agent tank 18 is supplied to the development section 3 so as to keep the amount of the liquid developing agent in the development section 3.

Subsequently, the image bearing belt 1 on which the liquid developing agent has been applied and the toner image has emerged is dried by the drying section 5, and thereby the solvent of the liquid developing agent is removed (step S6). Subsequently, the toner image on the surface of the image bearing belt 1 is transferred by the toner image transfer section 8 to the surface of the paper which is supplied from the paper feed line 7 (step S7).

Thereafter, the image bearing belt 1 after the toner image transfer is irradiated by the neutralizer lamp 9, and the residual toner on the surface of the image bearing belt 1 is removed by the cleaning section 10 (step S8). By the process described above, electrophotographic image generation and printing by the electrophotographic printer is executed.

Meanwhile, the image density control operation is executed by the electrophotographic printer. Referring to FIG. 3, the toner concentration in the liquid developing agent stored in the development section 3 is measured by the toner concentration sensor 6 at predetermined periods (step T1). The analog output signal of the toner concentration sensor 6 is converted by the A/D converter 17 to the digital signal (step T2), and the digital signal is inputted to the CPU 12 (step T3). The CPU 12 which received the digital signal compares the toner concentration detected by the toner concentration sensor 6 with a preset target value, and thereby outputs a development bias voltage control signal according to the result of the comparison to the power supply 14 (step T4). The power supply 14 changes and controls the development bias voltage according to the development bias voltage control signal. For example, when the toner concentration detected by the toner concentration sensor 6 is high, the power supply 14 lowers the development bias voltage according to the development bias voltage control signal, and thereby decreases the electrical charges on the toner particles in the liquid developing agent on the development roller 3*a*. On the other hand, when the toner concentration detected by the toner concentration sensor 6 is low, the power supply 14 raises the development bias voltage according to the development bias voltage control signal, and thereby increases the electrical charges on the toner particles in the liquid developing agent on the development roller 3*a*. The extent of the change of the development bias voltage is determined according to the development bias voltage control signal supplied from the CPU 12 (step T5). By the above operations, the amount of the toner particles which are applied by the development roller 3*a* to the latent image on the surface of the image bearing belt 1 is maintained almost constant, even if the toner concentration in the liquid developing agent varied.

As described above, in the electrophotographic printer according to the embodiment of the present invention, the density of the printed picture image can be controlled adequately even if the toner concentration in the liquid developing agent varied. The above image density control in the embodiment is executed very quickly by controlling the development bias voltage according to the measurement of the toner concentration, and thus the aforementioned time lag can be avoided and the density of the printed picture image can be maintained constant.

Incidentally, while an example of the construction of the electrophotographic printer has been shown in FIG. 1 and the description has been given referring to FIG. 1, of course, the construction can be altered adequately based on design requirements etc.

In addition, while the electrophotographic printer of FIG. 1 executed the above density control only by controlling the amount of electrical charges on the toner particles in the liquid developing agent, it is also possible to let the electrophotographic printer additionally employ the conventional density control method, in which the liquid solvent or the toner particles are adequately added to the liquid developing agent according to the measurement of the toner concentration.

Further, while an electrophotographic printer has been described as an example of the electrophotographic image generation device, the present invention can also be applied to other types of electrophotographic image generation devices such as photocopiers etc.

Moreover, while the electrophotographic image generation device of the above embodiment had the image bearing body and the toner image transfer section as its components, of course, the present invention can also be applied to an electrophotographic image generation device that is not provided with an image bearing body nor a toner image transfer section, such as a wet developing device for developing a latent image on an image bearing body (an image bearing plate etc.).

As set forth hereinabove, in the electrophotographic image generation device and the electrophotographic image generation method according to the present invention, the amount of electrical charges on the toner particles in the liquid developing agent is controlled according to the measurement of the toner concentration in the liquid developing agent. Therefore, the amount of the toner particles which are applied on the latent image on the surface of the image bearing body can be controlled adequately and thereby the density of generated images can be controlled adequately, even if the toner concentration in the liquid developing agent varied. The density control can be executed very quickly, therefore, the time lag in the image density control can be avoided, and thus the density of the generated image can be maintained constant. By the attainment of the constant density electrophotographic image generation using the liquid developing agent, the size of the toner particles can be made smaller in comparison with other types of electrophotographic image generation devices employing the single-component developing agent etc. Therefore, uniform and finer electrophotographic image generation can be realized by the electrophotographic image generation device and the electrophotographic image generation method according to the present invention.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An electrophotographic image generation device comprising:

a development means for applying a liquid developing agent to the surface of an image bearing body on which a latent image due to variations in electric potential has been formed by irradiation of photo image light, and thereby changing the latent image into a visible toner image;

a toner concentration detection means for detecting the concentration of toner particles in the liquid developing agent; and an electrical charge control means for controlling the amount of electrical charges on the toner particles in the liquid developing agent in the development means according to the toner concentration detected by the toner concentration detection means.

2. An electrophotographic image generation device as claimed in claim 1, wherein the development means includes a development roller for applying the liquid developing agent to the surface of the image bearing body and a development bias voltage is applied to the development roller by a power source.

3. An electrophotographic image generation device as claimed in claim 2, wherein the electrical charge control means controls the amount of electrical charges on the toner particles on the development roller, by controlling the development bias voltage applied by the power source according to the toner concentration detected by the toner concentration detection means.

4. An electrophotographic image generation device as claimed in claim 3, wherein the toner concentration detection means is placed in the proximity of the development, roller.

5. An electrophotographic image generation device as claimed in claim 1, further comprising a liquid developing agent control addition means for adequately adding the liquid solvent or the toner particles of the liquid developing agent to the liquid developing agent to be consumed by the development means, depending on variations in the toner concentration in the liquid developing agent.

6. An electrophotographic image generation device comprising:

an image bearing means on which a latent image due to variations in electric potential is formed by irradiation of photo image light;

a development means for applying a liquid developing agent to the surface of the image bearing means and thereby changing the latent image into a visible toner image;

a toner image transfer means for transferring the toner image on the surface of the image bearing means to the surface of a sheet and thereby executing printing to the sheet;

a toner concentration detection means for detecting the concentration of toner particles in the liquid developing agent; and an electrical charge control means for controlling the amount of electrical charges on the toner particles in the liquid developing agent in the development means according to the toner concentration detected by the toner concentration detection means.

7. An electrophotographic image generation device as claimed in claim 6, wherein the development means includes a development roller for applying the liquid developing agent to the surface of the image bearing means, and a development bias voltage is applied to the development roller by a power source.

8. An electrophotographic image generation device as claimed in claim 7, wherein the electrical charge control means controls the amount of electrical charges on the toner particles on the development roller, by controlling the development bias voltage applied by the power source according to the toner concentration detected by the toner concentration detection means.

9. An electrophotographic image generation device as claimed in claim 8, wherein the toner concentration detection means is placed in the proximity of the development roller.

10. An electrophotographic image generation device as claimed in claim 6, further comprising a liquid developing agent control addition means for adequately adding the liquid solvent or the toner particles of the liquid developing agent to the liquid developing agent to be consumed by the development means, depending on variations in the toner concentration in the liquid developing agent.

11. An electrophotographic image generation method for an electrophotographic image generation device which is provided with a development means for applying a liquid developing agent on the surface of an image bearing body on which a latent image due to variations in electric potential has been formed by irradiation of photo image light, and thereby changing the latent image into a visible toner image, wherein:

the concentration of toner particles in the liquid developing agent is detected, and the amount of electrical charges on the toner particles in the liquid developing agent in the development means is controlled according to the detected toner concentration.

12. An electrophotographic image generation method as claimed in claim 11, wherein a development bias voltage is applied by a power source to a development roller which is provided in the development means for applying the liquid developing agent to the surface of the image bearing body.

13. An electrophotographic image generation method as claimed in claim 12, wherein the control of the amount of electrical charges on the toner particles in the liquid developing agent in the development means is executed by controlling the development bias voltage applied by the power source to the development roller according to the detected toner concentration.

14. An electrophotographic image generation method as claimed in claim 13, wherein the toner concentration is detected in the proximity of the development roller.

15. An electrophotographic image generation method as claimed in claim 11, wherein the toner image on the surface of the image bearing body is transferred to the surface of a sheet and thereby printing to the sheet is executed.

16. An electrophotographic image generation method as claimed in claim 11, wherein the liquid solvent or the toner particles of the liquid developing agent are adequately added to the liquid developing agent to be consumed by the development means, depending on variations in the toner concentration in the liquid developing agent.

* * * * *